US009931658B2

(12) United States Patent
Hofschulte et al.

(10) Patent No.: US 9,931,658 B2
(45) Date of Patent: Apr. 3, 2018

(54) SYSTEM AND METHOD FOR DETERMINING PROCESS PARAMETERS FOR THE ROBOT-BASED SPRAY APPLICATION OF VISCOUS FLUIDS

(71) Applicant: ABB Technology AG, Zurich (CH)

(72) Inventors: Jens Hofschulte, Friedrichsdorf (DE); Jurgen Ott, Grabsen (DE)

(73) Assignee: ABB Schweiz AG, Baden (CH)

( * ) Notice: Subject to any disclaimer, the term of this patent is extended or adjusted under 35 U.S.C. 154(b) by 163 days.

(21) Appl. No.: 14/755,293

(22) Filed: Jun. 30, 2015

(65) Prior Publication Data

US 2015/0375248 A1 Dec. 31, 2015

(30) Foreign Application Priority Data

Jun. 30, 2014 (EP) ..... 14002232

(51) Int. Cl.

| | |
|---|---|
| ***B05C 11/10*** | (2006.01) |
| ***B05B 12/08*** | (2006.01) |
| ***B05B 12/02*** | (2006.01) |
| ***B05B 13/04*** | (2006.01) |
| ***B05D 1/02*** | (2006.01) |

(52) U.S. Cl.

CPC ..... *B05B 12/081* (2013.01); *B05B 12/02* (2013.01); *B05B 12/084* (2013.01); *B05B 13/0431* (2013.01); *B05C 11/101* (2013.01); *B05D 1/02* (2013.01)

(58) Field of Classification Search

USPC ..... 118/663, 688, 712, 713, 689, 690, 691, 118/321, 323

See application file for complete search history.

(56) References Cited

U.S. PATENT DOCUMENTS

| | | | | |
|---|---|---|---|---|
| 5,065,695 | A * | 11/1991 | Baron | B05C 11/1023 118/300 |
| 5,119,759 | A * | 6/1992 | Hicks | B23K 3/06 118/323 |
| 6,541,063 | B1 * | 4/2003 | Prentice | H05K 13/0469 118/323 |
| 8,257,779 | B2 * | 9/2012 | Abernathy | B05C 5/0225 118/323 |
| 2006/0081039 | A1 | 4/2006 | Scheer | |
| 2007/0231427 | A1 | 10/2007 | Ream | |

(Continued)

OTHER PUBLICATIONS

European Patent Office, Search Report and Opinion for EP Appl. No. 14002232.8, dated Jan. 21, 2015, 6 pages.

*Primary Examiner* — Yewebdar T Tadesse
(74) *Attorney, Agent, or Firm* — Barnes & Thornburg LLP

(57) ABSTRACT

A system is disclosed for determining process parameters for the spray application of viscous fluids, which can include an application system, which can be actuated by predefining input parameters, for a viscous fluid having at least the components of metering device, fluid valve and application nozzle. The dynamic behavior of the application system can be dependent, with respect to the volume flow profile of the viscous fluid during the application, and also on predefinable control process parameters. Methods are disclosed for determining and applying process parameters for the spray application of viscous fluids with a system, and for controlling the spray application of an application system, which can be actuated by predefining input parameters, for a viscous fluid.

5 Claims, 4 Drawing Sheets

(56) References Cited

U.S. PATENT DOCUMENTS

| | | | | |
|---|---|---|---|---|
| 2009/0087541 | A1 | 4/2009 | Jow et al. | |
| 2014/0102811 | A1* | 4/2014 | Danwerth | G01G 11/046 177/1 |

* cited by examiner

SYSTEM AND METHOD FOR DETERMINING PROCESS PARAMETERS FOR THE ROBOT-BASED SPRAY APPLICATION OF VISCOUS FLUIDS

RELATED APPLICATION(S)

This application claims priority to European Application 14 002 232.8 filed in Europe on Jun. 30, 2014. The entire content of which is hereby incorporated by reference in its entirety.

FIELD

The disclosure relates to a system for determining process parameters for the spray application of viscous fluids, including an application system, which can be actuated by predefining input parameters, for a viscous fluid having at least the components of a metering device, fluid valve and application nozzle, wherein the dynamic behaviour of the application system with respect to the volume flow profile of the viscous fluid during the application can also be dependent on, for example, predefinable control process parameters.

BACKGROUND INFORMATION

In many fields of industrial production, a spray application of viscous or highly viscous fluids can be used, for example in the car industry when applying sound absorption mats or for seam sealing. The application of adhesives can also be a field of use for the spray application.

A corresponding application system can include a metering device, a hose connection, an application nozzle, and a fluid valve situated close to the application nozzle in terms of fluid mechanics. With the fluid valve, the fluid duct which can be formed by the specified components can be selectively interrupted between the metering device and the application nozzle in order, for example, to help prevent the fluid from dripping out of the application nozzle when the metering device is switched off. This brings about coordination of the switching on and off of the metering device and fluid valve in order, for example, to avoid a situation in which the metering element can be switched on while the fluid valve is still closed, which can bring about a rise in pressure.

Due to the high viscosity of the material to be applied, the application of the material should be occur under high pressure, for example, by using a metering cylinder with a servo drive. However, those skilled in the art can be aware of further embodiments of metering devices, for example, gear pumps or spiral pumps, wherein a servo motor cam also frequently serve as the drive here. The hose connection between the metering cylinder and the application nozzle is to be configured as a high-pressure hose. An application system therefore has a dynamic behaviour which can be dependent on a number of factors, for example, the extensibility of the hose, the rotary masses of the drive of the metering device and delay times, for example, during the switching on or off of the metering device or the switching on or off of the fluid valve. However, the type of viscous fluid to be applied can also include an influence on the dynamic behaviour of an application system, and wherein charge fluctuations of the viscous fluid can also have an influence on the dynamic behaviour.

The final geometric shape of the viscous material which is applied to the surface of an object under high pressure by an application nozzle can be dependent on the width and homogeneity of the spray jet, the speed at which the application nozzle is moved over the surface of the object to be sprayed, for example, a robot, and the respective volume flow through the application nozzle. Due to a linear movement of the application nozzle, the viscous material can be applied in a strip-like shape to the surface of an object.

A layer thickness which is as homogeneous and a constant width of the applied material strip are usually desired, wherein the width of said strip is dependent to a high degree on the volume flow of the fluid through the fluid duct of the application system during the application process. However, after a change in the input parameters of the application system, on account of the high dynamics, already mentioned, of such an application system, for example, the flow volume can be subjected to certain dynamic fluctuations which can also bring about a deviation, for example, of the actually applied strip width from the desired strip width.

In order to improve the dynamic behaviour of an application system, the input parameters of the application system, such as, for example, the rotational speed predefinition of the drive, can be fed, before its application, to a pre-processing stage such as a filter and thereby adapted. Given a corresponding selection of the process parameters of the pre-processing stage, or of the filter parameters, the dynamic behaviour of an application system can be improved.

The determination of the such process parameters on the basis of measurement technology can prove to be very complex and subject to faults. Known through-flow meters have to be integrated into the fluid duct in order to measure the volume flow and can influence the dynamic behaviour thereof, with the result that process parameters which are determined based on such a measurement can be imprecise. A further exemplary embodiment of the estimation of such process parameters or the empirical determination thereof can prove to be very time-consuming and likewise imprecise.

SUMMARY

A system is disclosed for determining process parameters for the spray application of viscous fluids, comprising: an application system for spraying an impacted object, configured to be actuated by predefining input parameters, for a viscous fluid having at least a metering device, a fluid valve and an application nozzle, wherein a dynamic behaviour of the application system is dependent, with respect to a volume flow profile of the viscous fluid during the application and predefinable control process parameters; a balance for continuously determining a weight of the impacted object, including the viscous fluid applied to the impacted object, and for generating a weight profile in the form of continuous measurement data from the balance; and at least one computing device configured to: actuate the application system with a sequence of changed input parameters; determine from the weight profile and a volume flow profile and correlate chronologically with a respective change in the input parameters, of an applied viscous fluid; and determine the input parameters, the volume flow profile, at least one predefined dynamic volume flow profile, and the predefinable control process parameters, optimized in terms of control with respect to at least one predefinable optimization variable, for the application system.

A method is disclosed for determining and applying process parameters for the spray application of viscous fluids with an application system or an impacted object, which can be actuated by predefining input parameters, for a viscous fluid having at least a metering device, a fluid valve and an application nozzle, wherein a dynamic behaviour of the application system is dependent, with respect to a volume flow profile of the viscous fluid during the application and predefinable control process parameters, a balance for continuously determining a weight of the impacted object, including the viscous fluid applied to the impacted object, and at least one computing device, the method comprising: making available a transmission function model for modelling the dynamic behaviour of the application system; actuating the application system according to a sequence of changed input parameters, wherein a viscous fluid is applied to the impacted object; continuously determining the weight of the impacted object including the viscous fluid applied thereto; continuously determining the volume flow profile of the applied fluid on a basis of an increase in weight as a function of time; determining suitable parameters for the transmission function model on the basis of at least the predefined input parameters as input variables and the associated volume flow profile as an output variable, to define a transmission function; predefining a desired dynamic volume flow profile; determining process parameters, which are modified in terms of control with respect to at least one predefinable optimization criterion, based on the transmission function and the desired dynamic volume flow profile; and transmitting the determined process parameters into this or into a structurally identical, actuable application system.

A method is disclosed for controlling a spray application of an application system, which can be actuated by predefining input parameters, for a viscous fluid having at least the components of a metering device, a fluid valve and an application nozzle, the method comprising: making available a transmission function for modelling a dynamic behaviour of the application system, wherein the transmission function includes the predefined input parameters as input variables and an associated volume flow profile as an output variable; applying a viscous fluid via the application system while predefining input parameters and an associated ideal volume flow profile which is to be achieved; continuously estimating the real volume flow profile via the at least the transmission function; and controlling the input parameters in such a way that, during the application, the estimated volume flow profile corresponds to the associated ideal volume flow profile.

BRIEF DESCRIPTION OF THE DRAWINGS

The disclosure is explained below with reference to the exemplary embodiments shown in the drawings. In the drawings.

DETAILED DESCRIPTION

Figure 1:
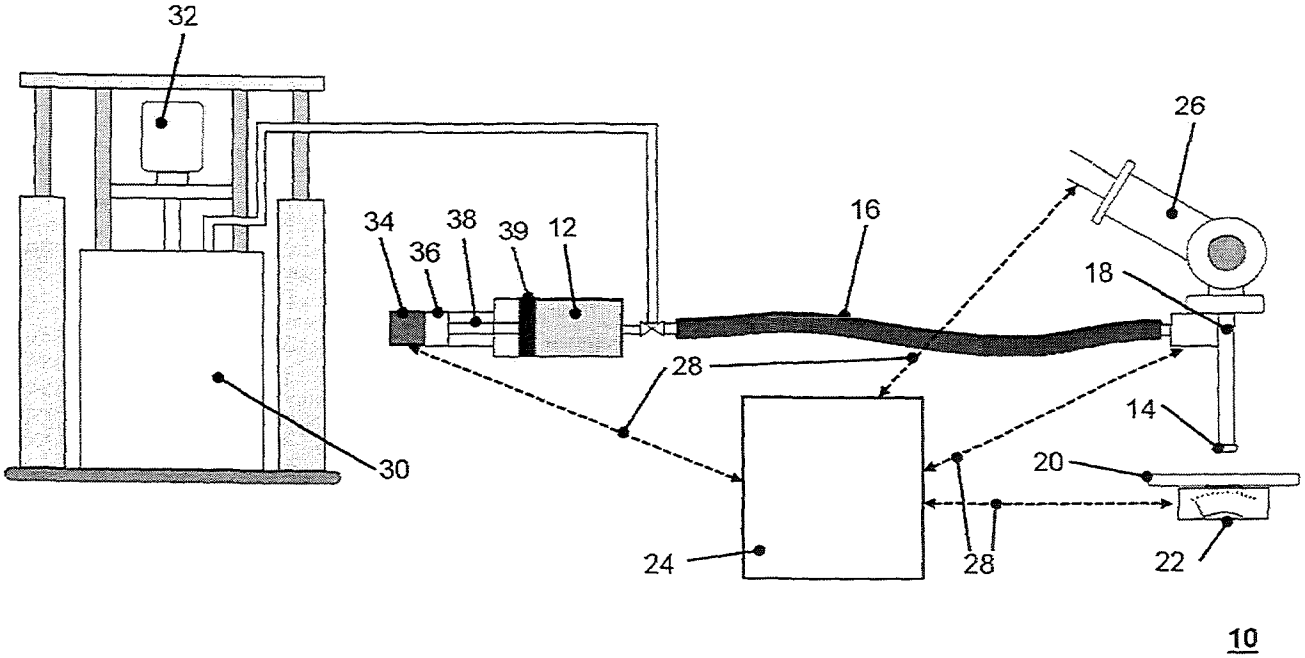
FIG. 1 shows an exemplary system for determining process parameters.

A system and method are disclosed which permit selective determination of the process parameters of a pre-processing stage without in the process falsifying the dynamic behaviour of the respective application system as a result of a volume flow measurement.

A system is disclosed for determining process parameters for the spray application of viscous fluids of the type mentioned at the beginning. The system consisting of an impacted object to be sprayed with the viscous fluid by the application system, a balance for continuously determining the weight of the impacted object, including the viscous fluid applied thereto, wherein the balance is provided to make available a weight profile in the form of continuous measurement data, at least one computing device which is provided for actuating the application system with a sequence of changed input parameters, for determining from the weight profile a volume flow profile, correlating chronologically with the respective change in the input parameters, of the applied fluid, for determining and making available, on the basis of the input parameters, the determined volume flow profile as well as at least one predefined dynamic volume flow profile, process parameters, optimized in terms of control with respect to at least one predefinable optimization variable, for the application system.

In accordance with an exemplary embodiment, a system and method are disclosed, which can carry out, for the determination of the process parameters, a volume flow measurement on the basis of a weight profile of the viscous fluid which can be applied to an impacted object, by which falsification of the dynamic behaviour of the application system can be avoided.

The volume flow measurement which is used can be an indirect measurement by means of which the weight of the viscous fluid which can be applied to an impacted object is firstly determined continuously. Based on the increase in weight of the impacted object to which the viscous fluid is applied, an increase in volume of the applied fluid per unit of time can be determined on the basis of the specific density of the viscous fluid. If the increase in volume is considered over correspondingly short sampling time periods of, for example, 2 ms, a corresponding volume flow can be calculated therefrom, wherein any stochastic fluctuations in the respective measurement can be reduced, for example, by using digital filters.

In accordance with an exemplary embodiment, the measurement of the weight of the applied fluid is therefore not carried out until after the fluid has left the application system. This can preclude any influence on the dynamic behaviour of the application system.

By means of the determined volume flow, the real behaviour of the application system can be determined for the respectively applicable input parameters, for example, a predefined rotational speed. In the steady-state case, for example, in the case of constant input parameters, the volume flow, which can be predefined indirectly by the input parameters corresponds to the actual volume flow, if the application system is correctly calibrated. If, for example, a piston metering element with a servo drive is used, then a specific volume which is applied corresponds to each rotation of the spindle. In this case, an input parameter for achieving a desired volume flow would then be a rotational speed predefinition for the spindle drive.

However, if a chronological sequence of changed input parameters is predefined, owing to the dynamic behaviour of the application system a corresponding transient response of the volume flow occurs as a response of the application system after each change in the input parameters. By assigning the change in the input parameters, which can excite the system and the respective step responses, a transmission function, by which the relationship between the input parameters and the volume flow can be represented, can be identified in accordance with known control procedures.

A suitable transmission function model can be, for example, a transmission function polynomial:

$$F(z) = \frac{y(z)}{u(z)} = \frac{b_0 z^m + b_1 z^{m-1} + \ldots + b_{m-1} z + b_m}{z^n + a_1 z^{n-1} + \ldots + a_{n-1} z + a_n}$$

An estimate of the parameters of the transmission function model can be made according to a large number of methods known to those skilled in the art, for example, by transmitting the transmission function model into the time domain and solving corresponding differential equations, the Gaussian/Newtonian estimation method, the use of Markov parameters or the Prediction Error Method (PEM). The more measured values of various dynamic transient responses are present, more precisely the transmission function can be approximated. After the parameters of the transmission function model have been correspondingly determined, a suitable transmission function can be made available which models the behaviour of the application system with a high level of precision.

With knowledge of a suitable mathematical transmission function, the process parameters for the pre-processing stage can be determined, referred to as the shoot parameters, by which the chronological profile of the predefinitions of the input parameters for the application system is adapted in such a way that undesired dynamic compensation processes during the transient response after a change in a parameter are counteracted. Improved control of the application system can also be made.

The shoot parameters are the process parameters of the control pre-processing stage for the input parameters of the application system. A pre-processing stage can be formed, for example, by a (digital) filter. In order to determine the shoot parameters, an "ideal" dynamic volume flow profile and the corresponding input parameters can be predefined, and the shoot parameters can be adapted in such a way that the associated dynamic volume flow profile, determined by the transmission function, is as close as possible to the "ideal" profile. This can be done in the simplest case in an empirical fashion, but the sequence for this can be ideally automated, for example, using a corresponding program product, which can be installed on the computing device. However, the shoot parameters can be, for example, selectively determined by inverting the transmission function.

The computing device can be a personal computer, but it can also be equally possible to transfer at least some of the tasks to be carried out by the computing device to a robot controller which is responsible for controlling a robot which is integrated into the system according to the disclosure. This can provide, for example, the advantage that the movement of the robot and the control of the application system can be carried out coordinated chronologically with one another by the same computing device or the robot controller. In accordance with an exemplary embodiment, an additional computing device can be avoided by all the tasks to be carried out being carried out by the robot controller.

According to an exemplary embodiment of the system according to the disclosure, the impacted object can be a vertically oriented plate. As a result, any impact effects of the viscous fluid impacting in this case horizontally on the impact plate do not in fact bring about a falsification of the measurement result, which can be based on determination of the vertically acting weight force. If, the viscous fluid were to be applied vertically to a horizontal impact plate, an impact pulse profile of the impacting fluid would still be superimposed on the determined weight profile. In this embodiment, the application nozzle can be oriented in such a way that the fluid jet which is applied from it exits the nozzle at least approximately horizontally.

According to an exemplary embodiment of the system according to the disclosure, the balance can include a bending bar, which can serve as a weight sensor. For example, in the case of a vertical arrangement of a plate as an impact object and a horizontal arrangement of the bending bar, horizontally oriented impact pulses can be dissipated via the bending bar without as a result adversely affecting a measurement of the vertically acting weight force.

According to an exemplary embodiment of the disclosure, the balance can be provided for making available measurement data with a frequency of 100 Hz or higher. The greater the precision and the higher the frequency with which the chronological weight profile is sensed and made available, the more precisely can the volume flow profile be determined. The use of digital filters and therefore correction of stochastic measurement errors as well as intrinsic dynamics of the balance can be made in an appropriate way by a relatively high sampling frequency.

According to an exemplary embodiment of the system according to the disclosure, at least the application nozzle of the application system can be arranged on an industrial robot. The use of an industrial robot can permit the movement of the application nozzle relative to the impacted object to be controlled in a monitored fashion, wherein at least some of the working steps, which can be carried out by the computing device, can be carried out by an associated robot controller of the industrial robot.

A method is disclosed for determining and applying process parameters for the spray application of viscous fluids with a system according to the disclosure, including making available a transmission function model for modelling the dynamic behaviour of the application system, actuating the application system according to a sequence of changed input parameters, wherein a viscous fluid is applied to the impacted object, continuously determining the weight of the impacted object including the viscous fluid applied thereto, continuously determining the volume flow profile of the applied fluid on the basis of the increase in weight as a function of time, determining suitable parameters for the transmission function model on the basis of at least the predefined input parameters as input variables and the associated volume flow profile as an output variable, with the result that a transmission function is defined, predefining a desired dynamic volume flow profile, determining process parameters, which are optimized in terms of control with respect to at least one predefinable optimization criterion, on the basis of the transmission function and the desired dynamic volume flow profile, transmitting the determined process parameters into this or into a structurally identical, actuable application system.

In accordance with an exemplary embodiment, the volume flow can determine to a high degree the appearance of the applied fluid. Given a linear movement of the application nozzle along an object to be sprayed, there can be a resulting fluid strip. Depending on the application case, various shapes of the fluid strip can be desired, for example with a rectangular or ramp-like outline. Under certain circumstances, a specific vertical profile can also be initiated. Depending on the desired shape of the fluid strip, a necessary volume flow profile therefore results. In order to achieve this necessary volume flow profile, the latter can be predefined for the determination of the suitable process parameters as a desired dynamic volume flow profile.

In accordance with an exemplary embodiment, optimization criteria for the determination of the process parameters for the pre-processing stage can be, for example, the criteria known from control technology such as maximum steepness of the rise in the output variable or in the volume flow after a change in the input parameters, maximum overshooting, maximum undershooting or the like.

After the transmission of the process parameters which are determined in this way into this or into a structurally identical application system or a pre-processing stage for the input parameters thereof, the dynamic behaviour of this system when applying viscous fluid under production conditions can be improved by using these process parameters. At this point, the determined process parameters for an application system apply precisely for the use of the same viscous fluid and under the same peripheral conditions can be, for example, the temperature and spraying distance, because the thixotropic properties of various viscous fluids can differ from one another to a high degree.

A method is disclosed for controlling the spray application of an application system, which can be actuated by predefining input parameters, for a viscous fluid having at least the components of metering device, fluid valve and application nozzle, consisting of making available a transmission function for modelling the dynamic behaviour of the application system, wherein the transmission function includes the predefined input parameters as input variables and the associated volume flow profile as an output variable, applying a viscous fluid by means of the application system while predefining input parameters and an associated ideal volume flow profile which is to be achieved, continuously estimating the real volume flow profile by means of at least the transmission function, controlling the input parameters in such a way that, during the application, the estimated volume flow profile is as close as possible to the ideal volume flow profile to be achieved.

According to this exemplary embodiment, no open-loop control, but instead closed-loop control, of the volume flow can be provided according to the disclosure. As a result, the advantages which are familiar to those skilled in the art and which closed-loop control can include over open-loop control are provided. In order to make available the initiated controlled variable, the volume flow, and to avoid a negative influence on the application system by a volume flow meter, the volume flow profile can be, according to the disclosure, not measured but instead estimated using a transmission function. Therefore, it is not the application system itself but instead a function describing the dynamic behaviour of the transmission system which can be integrated into a control circuit.

FIG. 1 shows an exemplary system for determining process parameters in a schematic illustration 10. A metering device 12, including a metering drive 34, a gear mechanism 36 and a spindle 38, can be provided for forcing a viscous fluid with a predefined volume flow out of a metering cylinder 39. The volume flow can result from the rotational speed of the metering drive 34, wherein a specific volume can be assigned to each rotation on the basis of the peripheral geometric conditions. A predefinition of a desired volume flow can be made in this case by means of the input parameter of rotational speed of the metering drive 34.

The viscous fluid which can flow out of an outlet opening of the metering cylinder 39 can be fed to an application nozzle 14 via a high-pressure hose 16, wherein a fluid valve 18 is provided just upstream of the application nozzle 14 in terms of fluid mechanics, by means of which fluid valve 18 the fluid duct which can be formed by the components mentioned above can be shut off. The application nozzle 14 can be arranged at the distal end of the arm of an industrial robot 26, which can include, for example, 6 degrees of freedom of movement and an arm length of 2.5 m. As a result, controlled movement of the application nozzle 14 along the surface of an object to be sprayed can be made, wherein a spraying distance of, for example, 10 mm-20 mm is maintained.

In this example, the viscous fluid can be applied to an impacted object 20, in this case a low-weight, rigid plate which can be arranged underneath the application nozzle 14. The impacted object 20 can be arranged on a balance 22 which can be provided for continuously transmitting the weight of the impact plate 20, plus the viscous fluid applied thereto, to a computing device 24 by means of a communication line 28. The computing device 24 is in this example a robot controller, which can be provided for controlling the industrial robot 26 and the metering device 12.

A digital filter, which serves as a pre-processing device or shoot filter for the input parameters of the application system and which can be realized as part of a software program product which can be installed on the computing device, is also provided in the computing device. Through suitable selection of the process parameters of the shoot filter, the input parameters of the application system can be adapted in such a way that the dynamic behaviour of the application system is improved, that is to say the volume flow which actually exits at the application nozzle is as close as possible, even when the input parameters are changed, to the setpoint predefinition of the volume flow which results from the input parameters.

Figure 2:
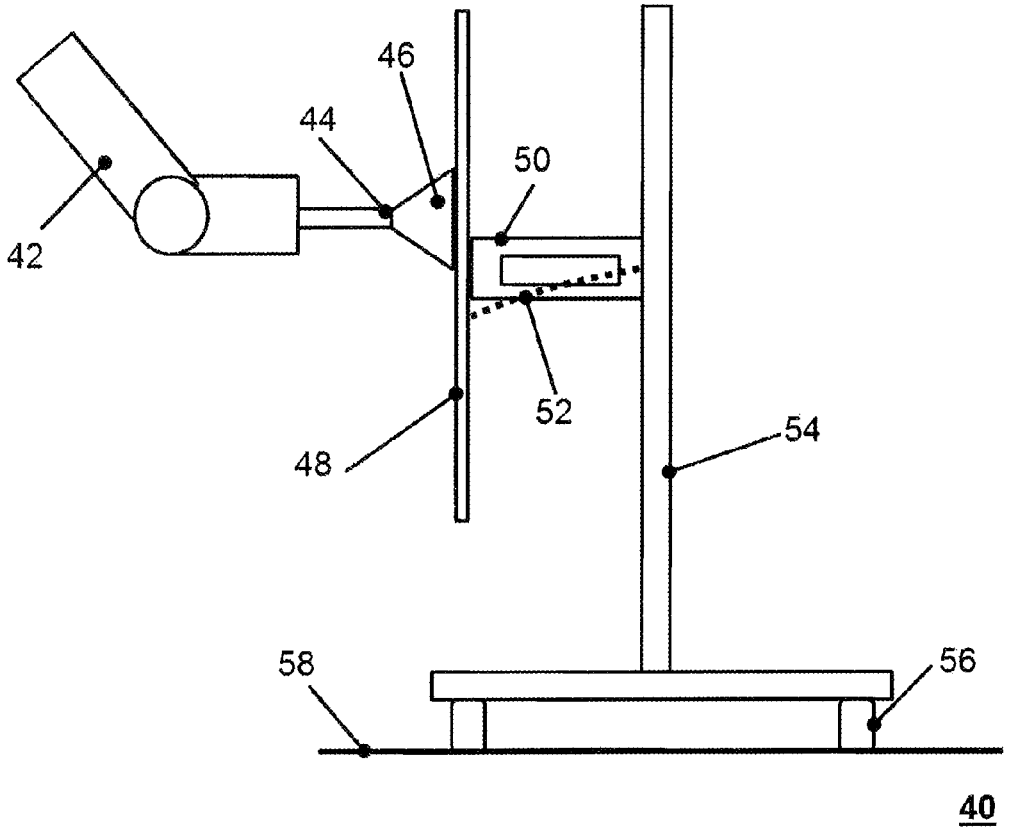
FIG. 2 shows part of an exemplary system for determining process parameters.

FIG. 2 shows part of an exemplary system for determining process parameters in a schematic illustration 40. An application nozzle 44 can be arranged at the distal end of an industrial robot 42, wherein a fluid jet 46 which emerges horizontally is directed onto an impacted object 48, in this case a vertically oriented plate. The weight of the impacted object 48 plus the viscous fluid applied thereto can be determined by a bending bar 50, wherein the latter is indicated in a bent state with a dashed line 52. The use of the bending bar 50 as a measuring sensor is known to those skilled in the art.

The vertical arrangement of the impacted object 48 or of the plate entails advantages because in this way a horizontal impact pulse which is caused by the impacting fluid jet 46 does not bring about a falsification of the vertically acting weight force which is sensed by the bending bar 50. The bending bar 50 can be connected at its other end to a supporting frame 54 which can be arranged for its part opposite a support face 58 on vibration dampers 56, as a result of which a negative influence on the quality of the determination of the weight by means of the bending bar 50 as a result of undesired vibrations can be reduced.

Figure 3:
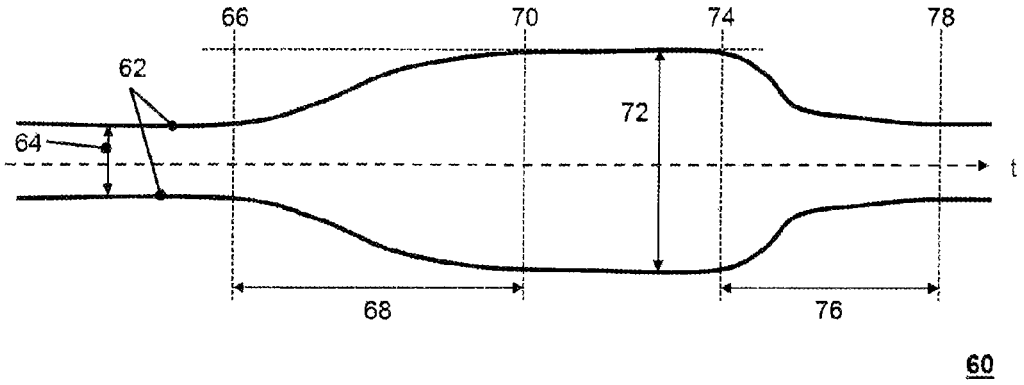
FIG. 3 shows an exemplary application result in the case of a varying volume flow profile.

FIG. 3 shows an exemplary application result in the case of a varying volume flow profile in a sketch 60. A fluid jet width profile of an application nozzle, which can be moved with a homogeneous speed over a plate, is illustrated with the reference number 62. The width of the fluid jet profile 62 can be considered at least in this example in a simplified fashion as being proportional to a corresponding volume flow profile. The fluid jet width or the associated volume flow before a first switching time 66 is indicated with an arrow 64. After the first switching time 66, the input parameters of the application system can be changed in such a way that an increased fluid jet width or an increased volume flow 72 is produced.

Due to the dynamic behaviour of the application system, a stable increase in the fluid jet width to the desired value does not occur immediately but rather only after a transition time period 68. During this transition time period 68, a type of transient response behaviour can occur which can be influenced by process parameters of a pre-processing device or a shoot filter. Depending on the optimization criteria according to which the process parameters were determined, an asymptotic approach to the value to be achieved occurs or a steeper rise with corresponding harmonics also comes about.

At a second switching time 74, the setpoint predefinition for the fluid jet width or the volume flow is reduced again, wherein a steady state does not occur here either until after a transition time period 76 starting from a time 78.

Figure 4:
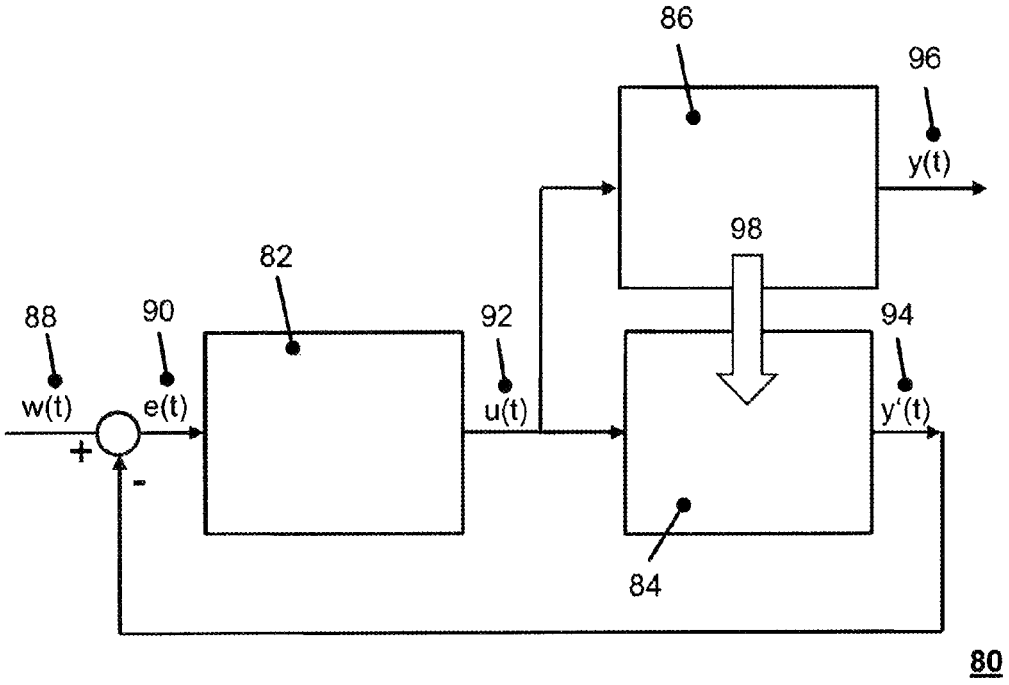
FIG. 4 shows an exemplary closed-loop control diagram with a transmission function.

FIG. 4 shows an exemplary closed-loop control diagram with transmission function in an illustration 80. As in a known closed-loop control diagram, a controller 82 can be provided to which the deviation of an actual variable 94 from a setpoint variable 88 is fed as a controlled variable, wherein both variables describe the volume flow. A manipulated variable 92, for example, the rotational speed predefinition for the drive of a metering device, can be made available as an output variable of the controller 82 and can be fed to an application system 86 and applied there, with the result that a real actual variable 96 can be produced for the volume flow.

In known control circuits, this real actual variable would have to be fed to the controller 82 in the form of a deviation from the setpoint variable predefinition 88. However, when the application system is used in production, this variable by means of real measuring technology cannot be determined without negatively affecting the dynamic behaviour of the application system. For this reason, according to the disclosure, there is provision to provide, instead of a real measurement of the actual variable for the volume flow, an estimate of the volume flow by means of a transmission function 84, and to provide the estimated value 94 as an actual value for the formation of differences. Known measurement variables 98 from the application system 86 can be optionally made available to the transmission function. The precision of the estimate is as a result can be increased.

Figure 5:
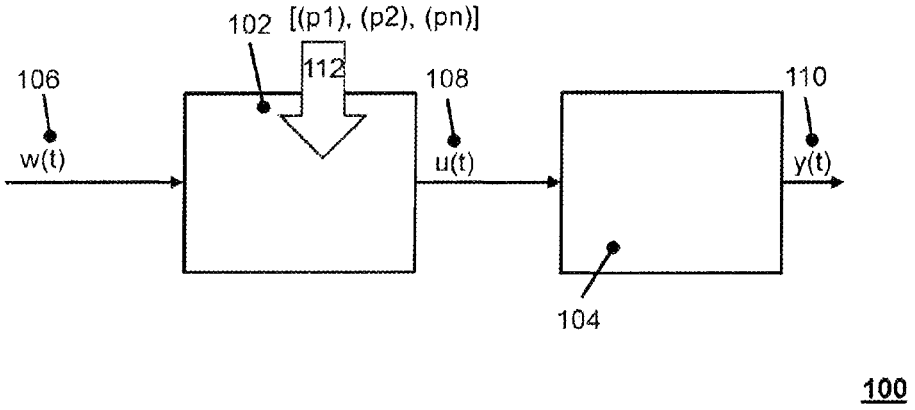
FIG. 5 shows an exemplary open-loop control diagram with a shoot filter.

FIG. 5 shows an exemplary open-loop control diagram with shoot filter 102 in an illustration 100. A desired volume flow profile is made available to the shoot filter 102, the behaviour of which can be dependent on the process parameters 112, in the form of setpoint variable predefinitions 106 for the volume flow, for example, a rotational speed predefinition for the drive of a metering unit. After adaptation of the setpoint variable predefinition 106 by the shoot filter 102, the input parameters 108 can be acquired for an application system 104, which then outputs a real actual variable 110, a volume flow, during the application. The use of the shoot filter 102 can cause the input parameters for the application system 104 to be adapted in such a way that its dynamic behaviour is improved.

Figure 6:
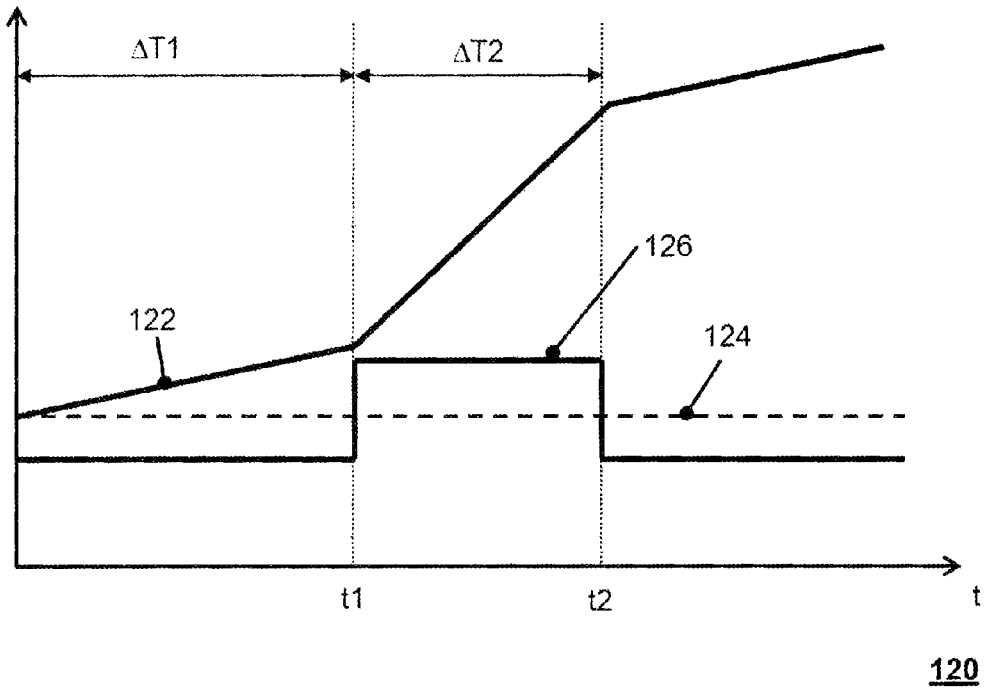
FIG. 6 shows an exemplary weight profile and an associated volume flow profile.

FIG. 6 shows an exemplary weight profile and an associated volume flow profile in an illustration 120. A weight profile of an impacted object during an application with a viscous fluid is indicated by the reference number 122. At the start of the application, the sensed weight corresponds to the (unladen) weight 124 of the impacted object. As the application time increases, a continuous increase in weight occurs, wherein, application is carried out with a different volume flow in different time periods ΔT. The volume flow profile 126 can ultimately result from the increase in weight per unit of time or from the mathematical derivative of the weight profile 122.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE NUMBERS

10 Exemplary system for determining process parameters
12 Metering device
14 Application nozzle
16 High-pressure hose
18 Fluid valve
20 Impacted object
22 Balance
24 Exemplary computing device
26 Industrial robot
28 Communication line
30 Fluid reservoir
32 Drive unit
34 Metering drive
36 Gear mechanism
38 Spindle
39 Metering cylinder
40 Part of an exemplary system for determining process parameters
42 Industrial robot
44 Application nozzle
46 Fluid jet
48 Impacted object
50 Bending bar (straight)
52 Bending bar (bent)
54 Supporting frame
56 Vibration damper
58 Support face
60 Exemplary application result in the case of a varying volume flow profile
62 Fluid jet width profile
64 Fluid jet width before first switching time
66 First switching time
68 Transition time period after first switching time
70 Time of start of steady-state time period after first switching time
72 Fluid jet width in steady-state time period
74 Second switching time
76 Transition time period after second switching time
78 Time of start of steady-state time period after second switching time
80 Exemplary closed-loop control diagram with a transmission function
82 Controller
84 Transmission function
86 Application system
88 Setpoint variable predefinition (volume flow)
90 Deviation of setpoint variable (volume flow)
92 Manipulated variable (input parameter)
94 Estimated actual variable (volume flow)
96 Real actual variable (volume flow)
98 Measurement variable

100 Exemplary open-loop control diagram with a shoot filter
102 Shoot filter
104 Application system
106 Setpoint variable predefinition (volume flow)
108 Manipulated variable (input parameter)
110 Real actual variable (volume flow)
112 Process parameter
120 Exemplary weight profile and associated volume flow profile
122 Weight profile
124 Weight of impacted object
126 Volume flow profile

What is claimed is:

1. A system for determining process parameters for the spray application of viscous fluids, comprising:

an application system for spraying an impacted object with a viscous fluid, the application system being configured to be actuated by predefining a set of input parameters and comprising a metering device, a fluid valve, and an application nozzle, wherein a dynamic behaviour of the application system with respect to a volume flow profile of the viscous fluid during application is dependent on predefinable control process parameters;

a balance for continuously determining a weight of the impacted object, including the viscous fluid applied to the impacted object, and for generating a weight profile in the form of continuous measurement data from the balance; and at least one computing device configured to:

actuate the application system with a sequence of differing sets of the input parameters, determine a sequence of volume flow profiles of the viscous fluid based on a sequence of weight profiles generated by the balance while the application system is actuated with the sequence of differing sets of the input parameters, such that the sequence of volume flow profiles and the sequence of weight profiles are each correlated chronologically with the sequence of differing sets of the input parameters, and determine the predefinable control process parameters for the application system based on the sets of the input parameters, the determined volume flow profiles, and at least one predefined dynamic volume flow profile, wherein the determined predefinable control process parameters are optimized in terms of control with respect to at least one predefinable optimization variable, wherein the set of the input parameters comprises at least one parameter corresponding with a volume flow from the metering device.

2. The system according to claim 1, in combination with an impacted object, wherein the impacted object is a vertically oriented plate.

3. The system according to claim 1, wherein the balance comprises:

a bending bar.

4. The system according to claim 1, wherein the balance is configured to for making available measurement data with a frequency of 100 Hz or higher.

5. The system according to claim 1, wherein at least the application nozzle of the application system is arranged on an industrial robot.

* * * * *